US005806128A

United States Patent [19]

Love

[11] Patent Number: 5,806,128

[45] Date of Patent: Sep. 15, 1998

[54] CLEANING TOOL

[76] Inventor: Georgina I. Love, 105 Sims Creek La., Jupiter, Fla. 33458

[21] Appl. No.: 792,516

[22] Filed: Feb. 10, 1997

[51] Int. Cl.[6] ..... A47L 13/16

[52] U.S. Cl. ..... 15/209.1; 15/235; 15/244.3

[58] Field of Search ..... 15/209.1, 210.1, 15/211, 235, 244.3, 247

[56] References Cited

U.S. PATENT DOCUMENTS

| | | | |
|---|---|---|---|
| 176,197 | 4/1876 | Rogers | 15/114 |
| D. 260,195 | 8/1981 | Kelly et al. | D1/22 |
| D. 269,917 | 7/1983 | Spann | D32/51 |
| D. 285,146 | 8/1986 | Abelira | D4/122 |
| D. 294,073 | 2/1988 | Lin | D32/51 |
| D. 324,137 | 2/1992 | Mendez | D4/137 |
| D. 356,443 | 3/1995 | Willis | D4/116 |
| D. 364,016 | 11/1995 | Aronson | D32/52 |
| 1,173,223 | 2/1916 | Severns | 15/229.5 |
| 1,420,169 | 6/1922 | Welch | 15/229.5 |
| 1,513,556 | 10/1924 | Lucia | 15/206 |
| 1,547,611 | 7/1925 | Rudolph et al. | 15/206 |
| 1,585,006 | 5/1926 | Zell | 15/228 |
| 1,977,473 | 10/1934 | Edwards | 15/229.4 |
| 2,048,033 | 7/1936 | Schaefer | 15/147.2 |
| 2,288,592 | 7/1942 | Mirhige | 15/247 |
| 2,315,054 | 3/1943 | Heber | 15/210.1 |
| 2,561,240 | 7/1951 | Spearman | 15/244.3 X |
| 2,699,565 | 1/1955 | Brough | 15/245 |
| 2,704,375 | 3/1955 | Haeusser | 15/247 X |
| 2,719,999 | 10/1955 | Hardin | 15/210.1 |
| 3,066,344 | 12/1962 | Borras et al. | 15/235 X |
| 3,332,103 | 7/1967 | Case | 401/203 |
| 3,869,555 | 3/1975 | Heonis | 426/134 |
| 4,120,068 | 10/1978 | Kaczmarek | 15/160 |
| 4,145,787 | 3/1979 | Bastian | 15/229.5 |
| 4,829,622 | 5/1989 | O'Sullivan | 15/209.1 |
| 4,888,844 | 12/1989 | Maggs | 15/106 |
| 4,945,599 | 8/1990 | Flynn | 15/247 X |
| 5,033,155 | 7/1991 | Klotz | 15/211 |
| 5,177,831 | 1/1993 | Wirth | 15/244.3 |
| 5,187,830 | 2/1993 | Giallourakis | 15/244.3 |
| 5,214,820 | 6/1993 | Shumway et al. | 15/118 |
| 5,591,507 | 1/1997 | Jones | 15/209.1 X |
| 5,598,596 | 2/1997 | Jones et al. | 15/244.3 X |

FOREIGN PATENT DOCUMENTS

| | | | |
|---|---|---|---|
| 0654251 | 11/1928 | France . | |
| 0692744 | 8/1930 | France . | |
| 1115137 | 4/1956 | France | 15/244.1 |
| 0479954 | 2/1938 | United Kingdom . | |
| 608699 | 9/1948 | United Kingdom . | |

*Primary Examiner*—Mark Spisich
*Attorney, Agent, or Firm*—Curtis L. Harrington

[57] ABSTRACT

A cleaning tool includes a fleece covering and support structures which both supported by a handle. The fleece material is sewn into a hollow cylinder and then turned inside out. A foam structure surrounds the upper end of the handle as it extends into the hollow fleece cylinder. A foam plug lies within the foam structure and cushions the upper end of the handle against the inside of the fleece material. Near the point of entry of the handle into the foam structure, the fleece material is attached to the handle to hold the cleaning tool together. Various shapes of cleaning tool can be formed with the overall outer shape of the fleece dependent upon both the cutting and sewing of the fleece material, as well as the shape of the supporting foam material.

4 Claims, 3 Drawing Sheets

CLEANING TOOL

FIELD OF THE INVENTION

The present invention relates to improved, simple construction, easy to use tool which is especially useful in applying cleaning and polishing solution to automobile wheels.

BACKGROUND OF THE INVENTION

Currently many different shapes and configurations of vehicle wheels are available as customized shapes in order to enhance the look of a vehicle. The term "wheels" is one which includes structures which directly support the tire to a hub, as well as many hub-cap type structures which overfit a conventional wheel. Both types of wheels may have intricate shapes and designs which collect dirt and brake debris.

The intricate, and sometimes delicate, openings on such wheels are such that a brush is virtually useless because the bristles will not conform to the shapes nor fit inside the small designs and holes. When a brush is shaped which will have a long enough bristle reach, the contact area of the bristle tips which can be applied against the surface is relatively small. Even more importantly most brushes, and especially brushes with long bristles, are incapable of holding and conserving cleaning solution or polishing solution. The cleaning solution is wasted since a brush must be dipped quickly and despite the user's best efforts, the solution is dripped on the ground. Even worse, the cleaning or polishing solution which reaches the wheel is not evenly applied. Uneven application results in spots left uncleaned and streaking.

Brushes also tend to scratch the surfaces to be cleaned. High end custom wheels can cost as much as $4000.00 per set and the owners sorely need a non-destructive cleaning tool for cleaning. The option to clean by hand, using towels or sponges, is good from a surface protection standpoint. However, most cleaning solutions are injurious to the hands and can severely stain the hands, especially under the fingernails. Severe staining may require months before wearing off, creating an unsightly appearance.

Another problem is the potential exposure of the underlying structure inherent in using a brush. Usually this is a twisted metal wire, or a hard plastic or wood substrate. Once the bristles are bent aside, the metal, plastic or wood substrate is free to scratch the wheels.

SUMMARY OF THE INVENTION

The cleaning tool of the present invention includes fleece covering and support structures which both supported by a handle. The fleece material is sewn into a hollow cylinder and then turned inside out. A foam structure surrounds the upper end of the handle as it extends into the hollow fleece cylinder. A foam plug lies within the foam structure and cushions the upper end of the handle against the inside of the fleece material. Near the point of entry of the handle into the foam structure, the fleece material is attached to the handle to hold the cleaning tool together. Various shapes of cleaning tool can be formed with the overall outer shape of the fleece dependent upon both the cutting and sewing of the fleece material, as well as the shape of the supporting foam material. The steps of forming the cleaning tool are illustrated, as well as a second embodiment wherein an angular cut is used to produce a conical shape in the finished cleaning tool.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
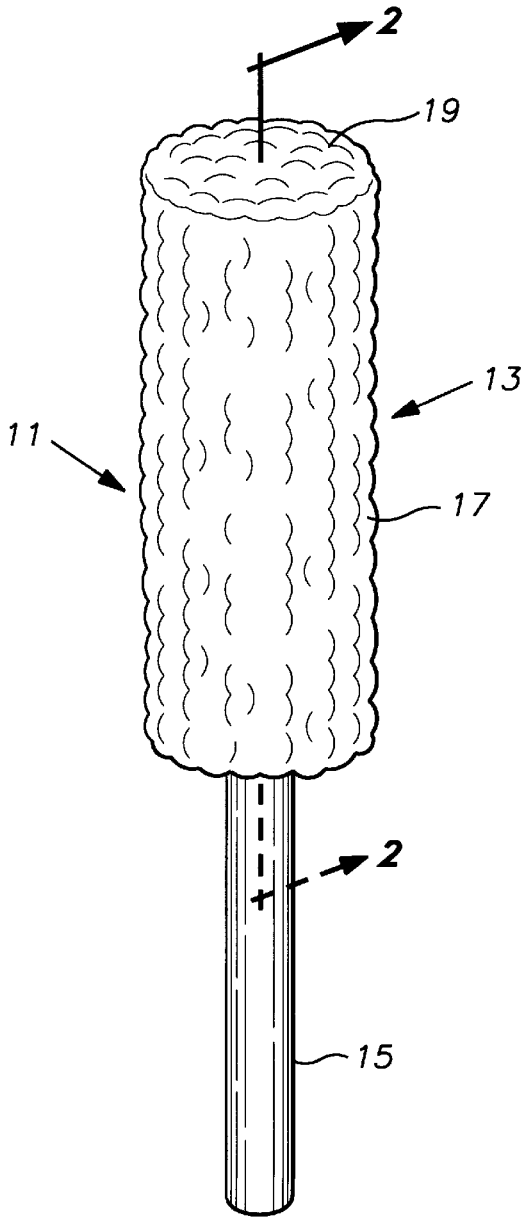
FIG. 1 is a perspective view of a cleaning tool of the invention and illustrating a cylindrical body with a relatively flat top.

The description and operation of the invention will be best described with reference to FIG. 1. FIG. 1 illustrates a cleaning tool 11 from an upper perspective view. Tool 11 has an upper fleece body 13 and a handle 15. The body 13 has a cylindrical side surface 17 which extends completely around the body 13. A top 19 of body 13 has a generally blunt surface.

Figure 2:
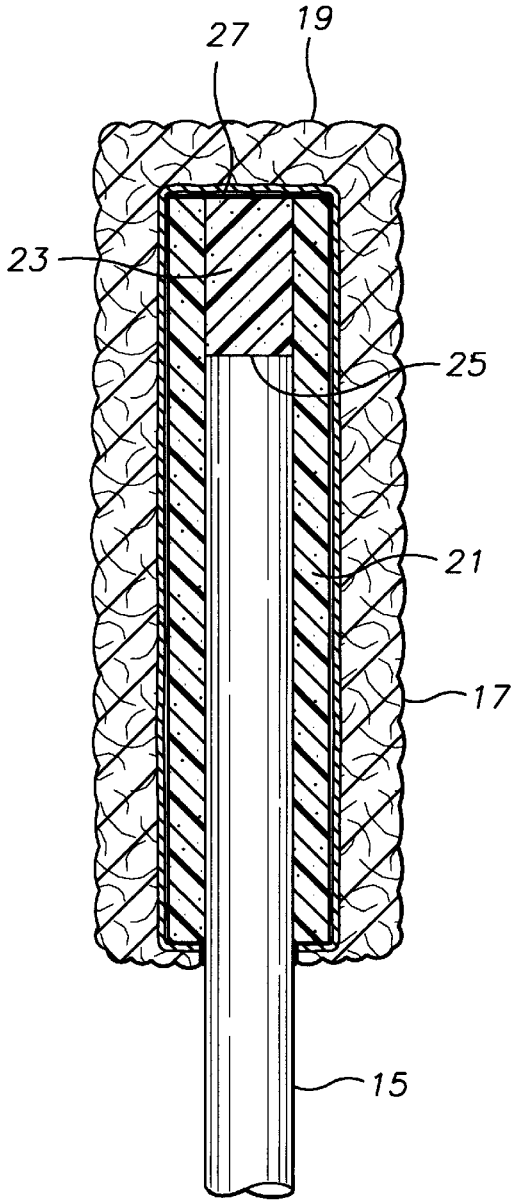
FIG. 2 is a front sectional view of the cleaning tool seen in FIG. 1 and taken along line 2—2.

Referring to FIG. 2, a cylindrical resilient member 21 is seen between the inner surface of the fleece body 13 and the outer surface of the upper portion of the handle 15. At the upper portion of the handle 15 and within the cylindrical resilient member 21 is a plug 23 having a first end 25 abutting the upper end of the handle 15 and a second end 27 abutting the upper inside portion of the top 19.

Figure 3:
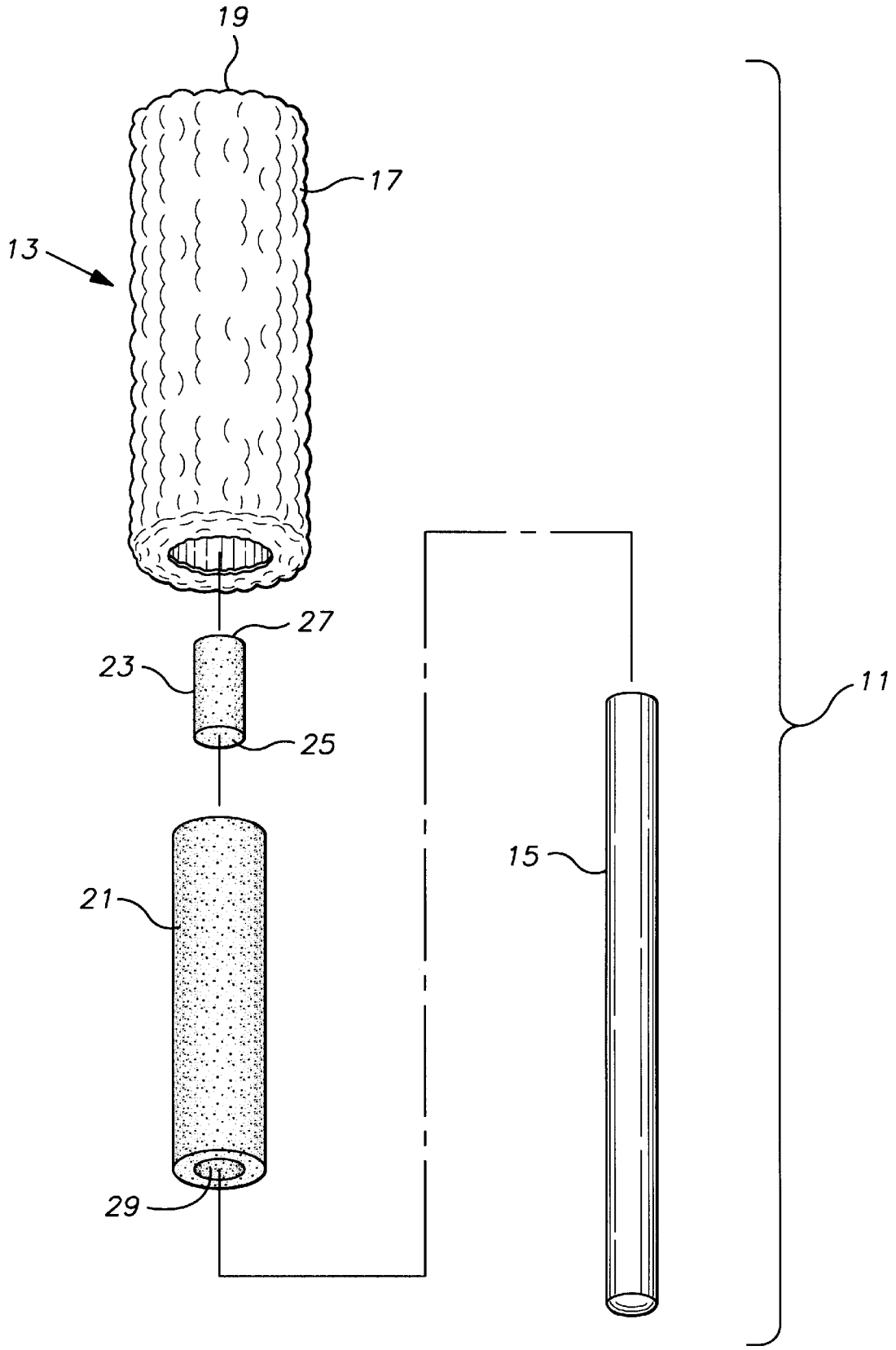
FIG. 3 is an exploded view showing assembly of the components of the cleaning tool of FIGS. 1 and 2.

Referring to FIG. 3, an exploded view illustrates the individual portions making up the cleaning tool 11. In one advantageous embodiment, the handle 15 should be about ten inches long and about 0.75 inches in diameter. The plug 23 should also have a diameter of about 0.75 inches and a length of about an inch. The cylindrical resilient member 21 should be about five inches in length and have an outer diameter of about fifteen sixteenths of an inch. The cylindrical resilient member 21 had an internal bore of about 0.75 inches, and it is permissible for the cylindrical resilient member 21 to have a slit down the side to facilitate either its manufacture or the placement of the handle within its central bore 29.

Figure 5:
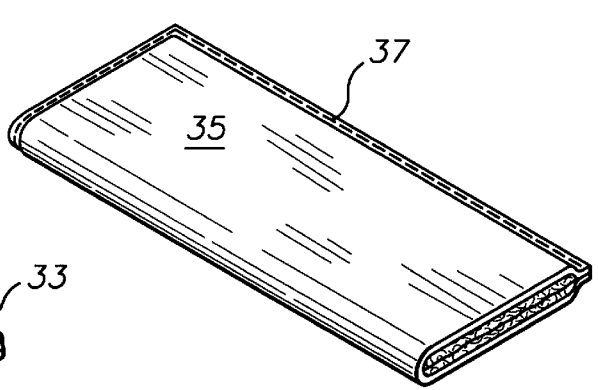
FIG. 5 illustrates the folded section of fleece as shown in FIG. 4 but with the addition of stitching across the top end and down the side.
Figure 4:
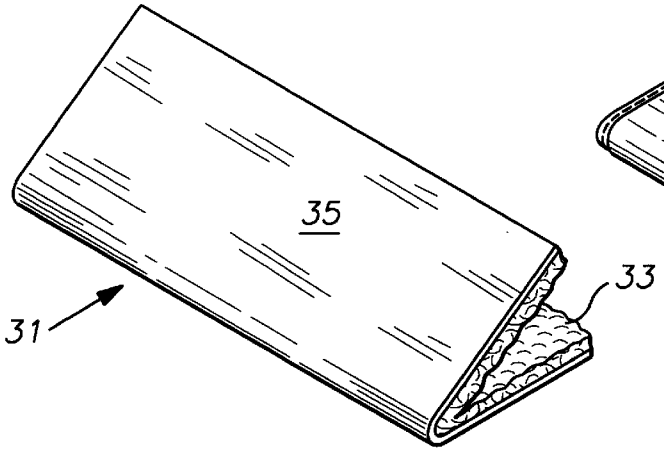
FIG. 4 illustrates a section of fleece material being folded as a first production step in forming the cleaning tool of FIGS. 1–3.

In the formation of the body 13 the steps include folding and sewing and then inverting. Referring to FIG. 4 a rectangular length of fleece material 31 has an outside surface 33 (exposed fleece material) and an inside surface 35. The fleece is folded so that the outside surface 33 of the folded halves face each other. FIG. 5 illustrates the addition of stitching 37 across the top and down the side of the fleece material 31 to form a pocket. The fleece material 31 is then turned inside out to yield the body 13 seen in FIG. 3.

Figure 8:
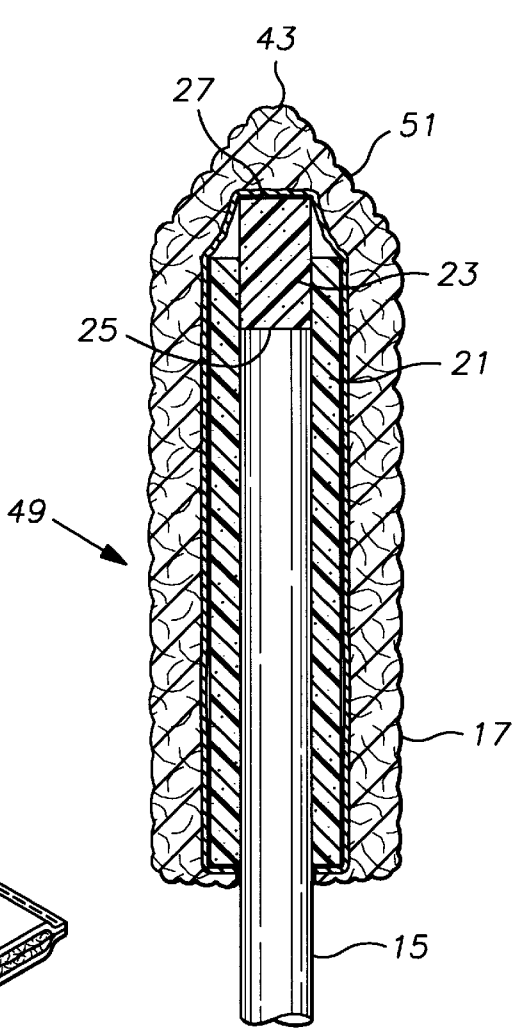
FIG. 8 illustrates a completed cleaning tool having a conical end and shown in section to illustrate support provided by a plug shown earlier in the drawings.
Figure 7:
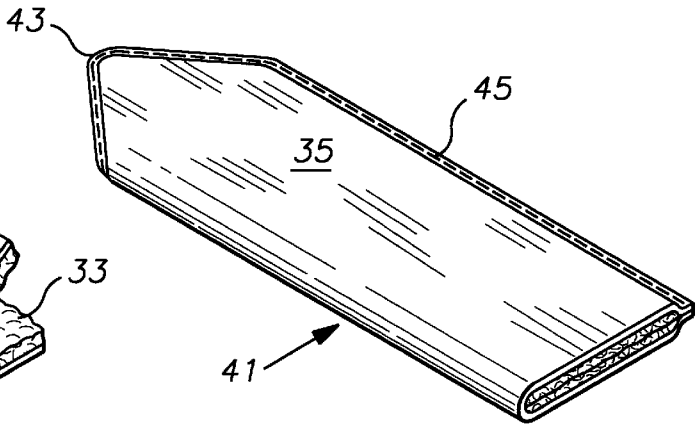
FIG. 7 illustrates the folded section of fleece as shown in FIG. 6 but with the addition of stitching across the top end and down the side.
Figure 6:
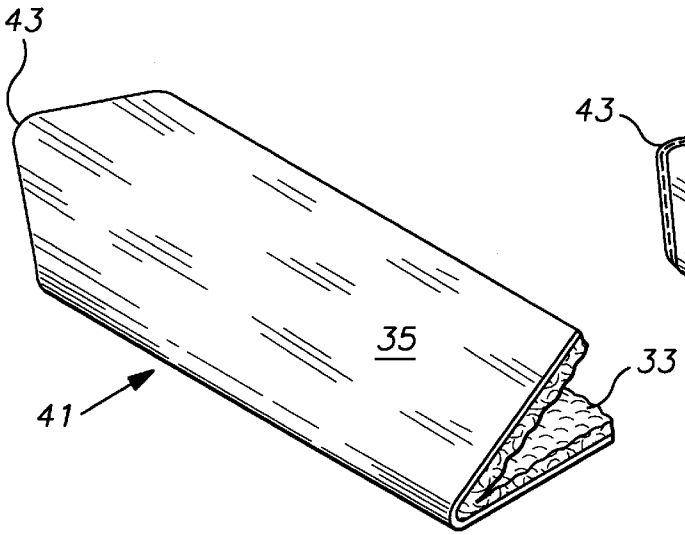
FIG. 6 illustrates a second embodiment of the section of fleece material being folded as a first production step in forming a cleaning tool having a conical end.

A variation on the outside shape of the end of the body 13 can be achieved by cutting an "M" shape in the end of a slightly longer length of fleece material 41 to result in an upward angular tip end 43 in the folded fleece material of FIG. 6. As is shown in FIG. 7, stitching 45 extends upward from the fold to the tip end 43 and down and along the length of the length of fleece material 41. The resulting pocket structure is inverted, or turned inside out to yield a body 13 having a cylindrical side surface 17, but having a conical upper surface 51. Internally, the plug 23 may have an extended length in order to provide support to the tip end 43 of the structure, shown in FIG. 8, although it is now seen as being on the outside surface 33 of the fleece 41.

The invention herein has been described with respect to a cleaning tool which provides both a gentle outer cleaning surface, as well as the ability to garner significant support from a handle extending through the core of the cleaning structure. The invention may be applied to any situation where pressure strength is to be applied to a relatively soft material and where a soft absorptive surface is to be manipulated from a distance.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A cleaning tool comprising:

an elongate handle having a first end and a second end, said first end of said handle having an upper end;

a cylindrical resilient material surrounding said first end of said handle, said cylindrical resilient material having a central bore extending along the entire length thereof in which said handle in located, said upper end of said handle being spaced from an upper end of said cylindrical resilient material so as to define a recess;

a hollow cylinder of fleece material enveloping said cylindrical resilient material having a closed end adjacent said first end of said handle and a second end closed against said handle between the first and second ends thereof; and a plug of resilient material located within said recess, said plug abutting said upper end of said handle and said closed end of said hollow cylinder of fleece.

2. The cleaning tool as recited in claim 1 and wherein said hollow cylinder of fleece material is a single piece of material stitched across an end and down a side of said single piece of material.

3. The cleaning tool as recited in claim 2 wherein said elongate handle is about twice as long as said hollow cylinder of fleece material and said second end of said hollow cylinder of fleece material is closed against said elongate handle substantially at the center of said elongate handle.

4. The cleaning tool as recited in claim 1 wherein said hollow cylinder of fleece material is a single piece of material having a tip end and stitched across said tip end and down a side of said single piece of material to form a conical shape at said closed end of said hollow cylinder of fleece material.

* * * * *